US006777863B1

(12) United States Patent
Okayama et al.

(10) Patent No.: US 6,777,863 B1
(45) Date of Patent: Aug. 17, 2004

(54) MATERIAL FOR APERTURE GRILL FOR COLOR PICTURE TUBE, PROCESS FOR MAKING THE SAME, APERTURE GRILL, AND PICTURE TUBE

(75) Inventors: Hironao Okayama, Yamaguchi (JP); Tsuneyuki Ide, Yamaguchi (JP); Yasuo Tahara, Yamaguchi (JP); Hiroshi Fujishige, Yamaguchi (JP); Akira Ikeda, Yamaguchi (JP); Setsuo Takaki, Fukuoka (JP)

(73) Assignee: Toyo Kohan., Ltd., Tokyo (JP)

( * ) Notice: Subject to any disclaimer, the term of this patent is extended or adjusted under 35 U.S.C. 154(b) by 0 days.

(21) Appl. No.: 09/646,349

(22) PCT Filed: Mar. 19, 1998

(86) PCT No.: PCT/JP98/01198

§ 371 (c)(1),
(2), (4) Date: Jan. 3, 2001

(87) PCT Pub. No.: WO99/47719

PCT Pub. Date: Sep. 23, 1999

(51) Int. Cl.[7] ..... H01J 29/80

(52) U.S. Cl. ..... 313/402; 313/407; 445/47; 148/651; 148/336

(58) Field of Search ..... 313/402–408; 445/47; 148/651, 336

(56) References Cited

FOREIGN PATENT DOCUMENTS

| | | | |
|---|---|---|---|
| JP | 6 73452 | | 3/1994 |
| JP | 06-073452 | * | 3/1994 |
| JP | 6 184701 | | 7/1994 |
| JP | 7-233443 | | 9/1995 |
| JP | 7 268557 | | 10/1995 |
| JP | 8 333654 | | 12/1996 |
| JP | 08-333654 | * | 12/1996 |

* cited by examiner

*Primary Examiner*—Edward J. Glick
*Assistant Examiner*—Jurie Yun
(74) *Attorney, Agent, or Firm*—Browdy and Neimark, P.L.L.C.

(57) ABSTRACT

A material is provided for marking aperture grilles for use in a color picture tube which has excellent yield strength, high temperature creep strength, and superior magnetic characteristics as compared to conventional materials. The material is made by cold-rolling a low carbon sheet containing 9 to 30 weight % of Ni or 9 to 30 weight % of Ni and 0.1 to 5 weight % of Co, and annealing the cold-rolled steel sheet at a temperature of 400–500° C.

6 Claims, No Drawings

MATERIAL FOR APERTURE GRILL FOR COLOR PICTURE TUBE, PROCESS FOR MAKING THE SAME, APERTURE GRILL, AND PICTURE TUBE

FIELD OF THE INVENTION

The present invention relates to a material for an aperture grille for use in a color picture tube, a producing method therefor, an aperture grille, and a color picture tube incorporating the aperture grille. More particularly, it relates to a material for an aperture grille for use in a color picture tube which has an excellent tensile strength and high temperature creep strength and besides good magnetic characteristics, and relates to a producing method therefor, an aperture grille made thereof, and a color picture tube incorporating this aperture grille.

BACKGROUND OF THE INVENTION

When an aperture grille is incorporated into a color picture tube, it is welded to the frame of the color picture tube while being applied under great tension. Therefore, a material for making an aperture grille for a color picture tube is required to have a tensile strength of at least 60 kgf/mm$^2$. Accordingly, the materials currently used for the aperture grille of the color picture tube comprise low carbon steel sheets, which have been reinforced by strengthening-forming.

Further, after being welded to the frame of the color picture tube, the aperture grille is subjected to a heat treatment for blackening. This heat treatment is carried out at 455° C. which is below the recrystallization temperature of steel for only a short time of about 15 minutes so that after blackening the tapes constituting the aperture grille may not be loosened but can be maintained with its loaded tensile strength. However, under such heat treatment conditions for blackening, the tapes cannot be entirely free from a recovery phenomenon but involve elongation of it by the recovery, thereby suffering cuts and twists. For this reason, a material for an aperture grille for use in a color picture tube is required to have a tensile strength of not less than 60 kgf/mm$^2$ and a creep strength enough to cause no elongation even when subjected to such a heat treatment for blackening as conducted at a temperature of 455° C. for a time of 15 minutes and to control its elongation of not more than 0.4% when the aperture grille is applied with a tensile strength of 30 kgf/mm$^2$.

The color picture tube comprises an electron gun and a luminescent screen which converts an electron beam into picture images. The inside of the picture tube is covered with a magnetic shield member so as to prevent the electron beam from being biased by geomagnetism. The aperture grille is also required to be used as the magnetic shield member and, therefore, should be made of a material having a great magnetic flux density (Br) and a small coercive force (Hc) representing the magnetic characteristics, in other words, a material having a great ratio of magnetic flux density to coercive force (Br/Hc). However, such a low carbon steel sheet as mentioned above, which has been subjected to strengthening-forming for obtaining a high tensile strength and also subjected to heat treatment for blackening at a temperature below its recrystallization temperature, has a small magnetic flue density of up to 8 kG and a great coercive force of about 5 Oe. Therefore, it is preferable in the present invention to use a material having a ratio of Br (kG) to Hc(Oe) exceeding 1.7.

So far, methods for improving tensile yield strength of a low carbon steel sheet include a solid solution strengthening method by means of carbon and nitrogen. The more the carbon or the nitrogen increases in the steel, the more increases carbide or nitride so that the movement of ferromagnetic domain walls will be prevented, inducing the impairment of the magnetic characteristics of the steel. Besides, methods for improving creep strength of a low carbon steel sheet include that of precipitating carbide or others in the steel. These precipitates have mostly a large grain size in micron order, which prevent the movement of ferromagnetic domain walls, greatly impairing the magnetic characteristics of the steel. Therefore, this method has not been applied as a method of producing a material for an aperture grille for use in a color cl picture tube.

The present invention has an object to provide a material for an aperture grille for use in a color picture tube which has an excellent tensile strength and high temperature creep strength and superior magnetic characteristics to prior materials, and provide a producing method therefor, an aperture grille made thereof, and a color picture tube incorporating this aperture grille.

DISCLOSURE OF THE INVENTION

The present invention relates to a material for an aperture grille for use in a color picture tube made of a low carbon steel sheet containing 9 to 30 wt % of Ni, and another embodiment of the invention relates to a material for an aperture grille for use in a color picture tube made of a low carbon containing 9 to 30 wt % of Ni and 0.1 to 5 wt % of Co.

Another embodiment of the present invention relates to a method of producing a material for an aperture grille for use in a color picture tube comprising the steps of cold-rolling a low carbon steel sheet containing 9 to 30 wt % of Ni and annealing same at a temperature of 400 to 500° C.

Another embodiment of the invention relates to a method of producing a material for an aperture grille for use in a color picture tube comprising the steps of cold-rolling a low carbon steel sheet containing 9 to 30 wt % of Ni and 0.1 to 5 wt % of Co and annealing same at a temperature of 400 to 500° C.

Still another embodiment of the invention relates to a method of producing a material for an aperture grille for use in a color picture tube which comprises the steps of cold-rolling a low carbon steel sheet containing 9 to 30 wt % of Ni, subjecting the same to process-annealing at a temperature of 500 to 800° C. and another cold-rolling, and annealing same at a temperature of 400 to 500° C.

Another embodiment of the invention relates to a method of producing a material for an aperture grille for use in a color picture tube which comprises the steps of cold-rolling a low carbon steel sheet containing 9 to 30 wt % of Ni and 0.1 to 5 wt % of Co, subjecting same to process-annealing at a temperature of 500 to 800° C. and another cold-rolling, and annealing same at a temperature of 400 to 500° C.

And embodiment of the invention relates to an aperture grille for use in a color picture tube, which is made of a low carbon steel sheet containing 9 to 30 wt % of Ni and another embodiment of the invention relates to an aperture grille for use in a color picture tube, which is made of a low carbon steel sheet containing 9 to 30 wt % of Ni and 0.1 to 5 wt % of Co.

An embodiment of the invention relates to a color picture tube incorporating an aperture grille made of a low carbon steel sheet containing 9 to 30 wt % of Ni and another embodiment of the invention relates to a color picture tube incorporating an aperture grille made of a low carbon steel sheet containing 9 to 30.

DESCRIPTION OF THE INVENTION

It proved that a steel sheet having a tensile strength of not less than 90 kgf/mm$^2$ and good magnetic characteristics could be obtained by the present invention. Namely, the invention comprises the steps of cold-rolling a hot-rolled sheet consisting of a single phase α' (martensite) to which Ni, or Ni and Co are added, or cold-rolling a hot-rolled Ni—Fe alloy sheet or Ni—Co—Fe alloy sheet consisting of double phases of α' and γ (austenite) into a single phase α' at a reduction rate of not less than 60% by means of the strain-induced transformation, and annealing same at a temperature of 400 to 500° C.

The present invention is now described below in detail.

In the present invention, a material for an aperture grille for use in a color picture tube is preferably a low carbon steel sheet obtained by the step of subjecting the steel sheet to a decarburization and denitrification treatment by use of a vacuum degassing process to decrease the carbide and nitride in the steel sheet and accelerate the growth of crystal grains during hot-rolling and annealing. In addition, since the carbide and nitride finely dispersed in the steel prevent the movement of ferromagnetic domain walls to thereby deteriorate the magnetic characteristics of the steel, it is necessary to prescribe the elements included in the steel beforehand and reduce them to the least. Now the explanation begins with sorts and amounts of the elements to be added to the steel which is to be used for the material for the aperture grille for use in the color picture tube of the present invention.

As for C, the more the carbon exists in the steel sheet after cold rolling, the more the carbide is produced to thereby prevent the movement of ferromagnetic domain walls and inhibit the growth of crystal grains, resulting in the impairment of the magnetic characteristics of the steel. For this reason, the upper limit of the addition amount of carbon is determined to be 0.01 wt %. The lower limit of the addition amount of carbon is desirably as little as it can be practically decreased through the vacuum degassing process.

As for Mn, manganese is essentially added to steel to react with sulfur in the steel so as to stabilize the sulfur as MnS, thus keeping the steel from embrittlement during hot rolling. However, it is desirable for improving the magnetic characteristics of the steel to minimize the amount of manganese. Therefore the addition amount of the manganese is limited up to 0.5 wt %.

As for S and N, the less sulfur and nitrogen are included in id the steel, the better the growth of crystal grains can be accelerated, so the addition amount of the sulfur and nitrogen is desirably limited up to 0.01 wt %.

As for Ni, not less than 9 wt % of nickel is added to steel so that the steel structure after hot-rolling can attain a single α' (martensite) phase having a ferromagnetism as strong as possible and the highest strength. When the addition amount of nickel increases, a martensite starting temperature (Ms point) drops and when the nickel amount exceeds 20 wt %, the metal structure at the normal temperature will be changed into the double phase alloy of α'+ austenite (γ). When the metal structure includes the γ phase, which is non-magnetic, its magnetic characteristics will be impaired. However, even when the nickel amount exceeds 20 wt %, as far as less than 30 wt %, the metal structure has its γ phase changed into an α' phase through the strain-induced modification by means of cold-rolling at a reduction rate of not less than 60%. When the nickel amount exceeds 30 wt %, the γ phase is stabilized and even if the steel sheet is subjected to cold-rolling, the strain-induced modification no longer takes place, with the result that no single α' phase is attained. Therefore, the upper limit of the nickel amount is determined to be 20 wt %.

Cobalt is an element that hardly affects the martensite starting temperature (Ms point) and makes it easy to form a superlattice through a heat treatment in a temperature range from 400° C. to 500° C. Thus, since cobalt effects an improvement in the tensile strength of the steel sheet as a material for a shadow mask, it is added thereto together with nickel. When the cobalt amount is less than 1.0 wt %, no effect can be obtained, and when more than 5 wt % of cobalt is added to the steel sheet, its coercive force increases so that Br(kG)/Hc(Oe) decreases, which is now unfavorable as a magnetic shield material. Therefore, the cobalt amount is determined to be 1 to 5 wt %.

Next, a method of producing a thin steel sheet as a material for an aperture grille for use in a color picture tube of the present invention is explained.

The producing method comprises the steps of hot-rolling low carbon steel containing the above mentioned chemical components which has been subjected to a vacuum melting process or vacuum degassing process to be melted, pickling same to remove an oxide film formed during the hot-rolling, subsequently cold-rolling same at a reduction rate of not less than 60% to form a thin steel sheet of 0.035 to 0.2 mm thickness; and annealing same at a temperature of 400 to 500° C. When the steel sheet is heated to a temperature of not less than 350° C., a super lattice of Ni—Fe or Ni—Fe—Co is formed in the steel sheet, where the magnetic flux density Br increases while the coercive force Hc decreases so that a value of Br/Hc increases. When the steel sheet is heated to around 450° C., the value of Br/Hc comes to the maximum. When heated to a temperature in excess of 500° C., the steel sheet has its α' phase transformed into a non-magnetic γ phase so that the value of Br/Hc drastically drops, impairing its magnetic characteristics. Therefore, the annealing temperature is desirably within the range from 400° C. to 500° C.

There may be another embodiment of the producing method of the present invention, which comprises the steps of hot-rolling the above mentioned low carbon steel sheet, pickling same, cold rolling same at a reduction rate of not less than 60% to form a steel sheet of 0.1~0.6 mm thickness, subsequently subjecting same to process-annealing at a temperature of 500 to 800° C. to control crystal grain sizes, subjecting same to another cold-rolling to form a thin steel sheet of 0.035 to 0.2 mm thickness, and annealing same at a temperature of 400 to 500° C. When the process-annealing temperature is lower than 500° C., the steel sheet cannot be softened enough. On the other hand, when the process-annealing temperature is higher than 800° C., the steel sheet cannot attain a desired yield strength after it is subjected to the secondary cold-rolling and the above mentioned annealing.

EXAMPLES

The present invention is described more in detail with regard to examples below.

Example 1

Eight different kinds of low carbon steel (A~H) which respectively contain Ni, or Ni and Co as shown in Table 1 were vacuum-degassed and melted to prepare slabs, which were hot-rolled to form hot-rolled sheets each having a thickness of 2.5 mm. These hot rolled sheets were subjected to sulfuric acid pickling and then cold rolling to form cold-rolled sheets each having a thickness of 0.1 mm. Thereafter, they were annealed at temperatures as shown in Table 1. The thus obtained steel sheet samples were applied with 10 oersted of magnetic field using a compact type Epstein magnetism measuring apparatus to measure their magnetic flux densities and coercive forces and calculate values of Br(kG)/Hc(Oe). The samples were also measured by use of TENSILON to obtain their tensile strengths, which are shown in Table 1.

Example 2

The same eight kinds of low carbon steel (A~H) which respectively contain Ni, or Ni and Co as shown in Example 1 were vacuum-degassed and melted to prepare slabs under the same id conditions as in Example 1, which were hot-rolled to form hot-rolled sheets each having a thickness of 2.5 mm. These hot-rolled sheets were subjected to sulfuric acid pickling and then cold rolling to form cold-rolled sheets each having a thickness of 0.3 mm. Thereafter, they were subjected to process-annealing at a temperature of 750° C. for a time of 40 minutes and another cold-rolling so as to have a thickness of 0.1 mm each. Subsequently, they were annealed at temperatures as shown in Table 2. The thus obtained steel sheet samples were measured for the magnetic flux density and coercive force in the same manner as in Example 1 and calculated for the value of Br (kG)/Hc(Oe). Further, they were measured for the tensile strength in the same manner as in

TABLE 1

(Table 1)

| Kind of Steel | Sample No. | Addition element(wt %) | Annealing temperature(° C.) | Tensile strength(kg/mm2) | Br/Hc (kG/Oe) | Division |
|---|---|---|---|---|---|---|
| A | A1 | Ni(9) | 400 | 110 | 2.4 | Example |
| | A2 | | 450 | 100 | 2.6 | Example |
| | A3 | | 500 | 95 | 2.8 | Example |
| | A4 | | 350 | 120 | 1.5 | Comparative example |
| | A5 | | 550 | 84 | 1.2 | Comparative example |
| B | B1 | Ni(15) | 400 | 112 | 2.4 | Example |
| | B2 | | 450 | 104 | 2.6 | Example |
| | B3 | | 500 | 97 | 2.8 | Example |
| | B4 | | 350 | 123 | 1.6 | Comparative example |
| | B5 | | 550 | 89 | 1.2 | Comparative example |
| C | C1 | Ni(20) | 400 | 115 | 2.6 | Example |
| | C2 | | 450 | 112 | 3.2 | Example |
| | C3 | | 500 | 101 | 2.3 | Example |
| | C4 | | 350 | 125 | 1.8 | Comparative example |
| | C5 | | 550 | 90 | 0.1 | Comparative example |
| D | D1 | Ni(25) | 400 | 110 | 2.4 | Example |
| | D2 | | 450 | 100 | 3.9 | Example |
| | D3 | | 500 | 90 | 1.8 | Example |
| | D4 | | 350 | 115 | 1.5 | Comparative example |
| | D5 | | 550 | 90 | 0.1 | Comparative example |
| E | E1 | Ni(30) | 400 | 100 | 2.8 | Example |
| | E2 | | 450 | 90 | 3.9 | Example |
| | E3 | | 500 | 85 | 1.6 | Example |
| | E4 | | 350 | 115 | 1.4 | Comparative example |
| | E5 | | 550 | 95 | 1.0 | Comparative example |
| F | F1 | Ni(20) | 400 | 117 | 2.4 | Example |
| | F2 | Co(0.1) | 450 | 114 | 3.1 | Example |
| | F3 | | 500 | 103 | 2.1 | Example |
| | F4 | | 350 | 127 | 1.6 | Comparative example |
| | F5 | | 550 | 92 | 0.1 | Comparative example |
| G | G1 | Ni(20) | 400 | 120 | 2.3 | Example |
| | G2 | Co(2) | 450 | 116 | 3.9 | Example |
| | G3 | | 500 | 103 | 1.6 | Example |
| | G4 | | 350 | 128 | 1.5 | Comparative example |
| | G5 | | 550 | 98 | 0.3 | Comparative example |
| H | H1 | Ni(20) | 400 | 125 | 2.0 | Example |
| | H2 | Co(5) | 450 | 120 | 2.2 | Example |
| | H3 | | 500 | 115 | 2.8 | Example |
| | H4 | | 350 | 130 | 1.1 | Comparative example |
| | H5 | | 550 | 105 | 0.5 | Comparative example |

TABLE 2

(Table 2)

| Kind of Steel | Sample No. | Addition element(wt %) | Annealing temperature(° C.) | Tensile strength(kg/mm2) | Br/Hc (kG/Oe) | Division |
|---|---|---|---|---|---|---|
| A | A1 | Ni(9) | 400 | 105 | 2.5 | Example |
| | A2 | | 450 | 95 | 2.7 | Example |
| | A3 | | 500 | 90 | 3.0 | Example |
| | A4 | | 350 | 110 | 1.5 | Comparative example |
| | A5 | | 550 | 80 | 1.4 | Comparative example |
| B | B1 | Ni(15) | 400 | 109 | 2.6 | Example |
| | B2 | | 450 | 100 | 2.8 | Example |
| | B3 | | 500 | 92 | 3.1 | Example |
| | B4 | | 350 | 118 | 1.5 | Comparative example |
| | B5 | | 550 | 88 | 1.2 | Comparative example |
| C | C1 | Ni(20) | 400 | 113 | 2.6 | Example |
| | C2 | | 450 | 107 | 3.4 | Example |
| | C3 | | 500 | 103 | 2.8 | Example |
| | C4 | | 350 | 115 | 1.8 | Comparative example |
| | C5 | | 550 | 91 | 0.1 | Comparative example |
| D | D1 | Ni(25) | 400 | 110 | 2.4 | Example |
| | D2 | | 450 | 100 | 4.0 | Example |
| | D3 | | 500 | 90 | 1.8 | Example |
| | D4 | | 350 | 115 | 1.5 | Comparative example |
| | D5 | | 550 | 88 | 0.1 | Comparative example |
| E | E1 | Ni(30) | 400 | 98 | 2.8 | Example |
| | E2 | | 450 | 93 | 3.9 | Example |
| | E3 | | 500 | 82 | 1.6 | Example |
| | E4 | | 350 | 102 | 1.4 | Comparative example |
| | E5 | | 550 | 80 | 1.0 | Comparative example |
| F | F1 | Ni(20) | 400 | 115 | 2.4 | Example |
| | F2 | Co(0.1) | 450 | 109 | 3.2 | Example |
| | F3 | | 500 | 105 | 2.6 | Example |
| | F4 | | 350 | 117 | 1.6 | Comparative example |
| | F5 | | 550 | 93 | 0.1 | Comparative example |
| G | G1 | Ni(20) | 400 | 117 | 2.4 | Example |
| | G2 | Co(2) | 450 | 112 | 2.9 | Example |
| | G3 | | 500 | 106 | 2.9 | Example |
| | G4 | | 350 | 120 | 1.6 | Comparative example |
| | G5 | | 550 | 98 | 0.3 | Comparative example |
| H | H1 | Ni(20) | 400 | 120 | 2.1 | Example |
| | H2 | Co(5) | 450 | 116 | 2.3 | Example |
| | H3 | | 500 | 109 | 3.0 | Example |
| | H4 | | 350 | 125 | 1.3 | Comparative example |
| | H5 | | 550 | 105 | 0.4 | Comparative example |

Possible use in the Industrial Field

The material for the aperture grille according to one embodiment comprises a low carbon steel sheet containing 9 to 30 wt % of Ni, and the material for the aperture grille according to another embodiment comprises a low carbon steel sheet containing 9 to 30 wt % of Ni and 0.1 to 5 wt % of Co. Therefore, they are excellent in the magnetic characteristics and strength.

The method of producing the material for the aperture grille according to one embodiment comprises the steps of cold-rolling a low carbon steel sheet containing 9 to 30 wt % of Ni and annealing same at a temperature of 400 to 500° C., the method of producing the material for the aperture grille according to another embodiment comprises the steps of cold-rolling a low carbon steel sheet containing 9 to 30 wt % of Ni and 0.1 to 5 wt % of Co and annealing same at a temperature of 400 to 500° C., the method of producing the material for the aperture grille according to another embodiment comprises the steps of cold-rolling a low carbon steel sheet containing 9 to 30 wt % of Ni, subjecting same to process-annealing at a temperature of 500 to 800° C. and another cold-rolling, and annealing same at a temperature of 400 to 500° C., and the method of producing the material for the aperture grille according to yet another embodiment comprises the steps of cold-rolling a low carton steel sheet containing 9 to 30 wt % of Ni and 0.1 to 5 wt % of Co, subjecting same to process-annealing at a temperature of 500 to 800° C. and another cold-rolling, and annealing same at a temperature of 400 to 500° C. Consequently, using these methods of the present invention, it is possible to obtain the materials for the aperture grille for use in the color picture tube having an excellent tensile strength of not less then 90 kgf/mm$^2$ and good magnetic characteristics as represented by the value of Br (kG)/Hc(Oe) exceeding 1.7.

In the aperture grilles or the color picture tubes according to other embodiments, the tapes constituting the aperture grilles are never loosened even when the aperture grilles are subjected to heat treatment for blackening after welded to the frame of the color picture tube.

What is claimed is:

1. A method of producing a material for an aperture grille for use in a color picture tube, comprising providing a low carbon steel sheet consisting of Fe, C, wherein said C is present in an amount no greater than 0.01 wt %, up to 0.5 wt % Mn, up to 0.3 wt % Si, up to 0.01 wt % S and N, 9 to 30 wt % of Ni and 0.1 to 5 wt % of Co;

cold-rolling the low carbon steel sheet at a reduction rate of not less than 60%; and annealing the low carbon steel sheet at a temperature of 400 to 500° C.

2. A color picture tube incorporating an aperture grille for use in a color cathode ray tube, which aperture grille is made of a low carbon steel sheet containing 9 to 30 wt % of Ni and 0.1 to 5 wt % of Co produced according to the method of claim 1.

3. A method of producing a material for an aperture grille for use in a color picture tube, comprising providing a low carbon steel sheet containing 9 to 30 wt % of Ni and being substantially free of tin;

annealing the low carbon steel sheet at a temperature of 500 to 800° C.;

subjecting the low carbon steel sheet to cold-rolling at a reduction rate not less than 60%; and annealing the low carbon steel sheet at a temperature of 400 to 500° C.

4. An aperture grille for use in a color picture tube, which is made of a low carbon steel sheet containing 9 to 30 wt % of Ni produced by the method of according to claim 3.

5. A method of producing a material for an aperture grille for use in a color picture tube, comprising providing a low carbon steel sheet containing 9 to 30 wt % of Ni and 0.1 to 5 wt % of Co, and being substantially free of tin;

annealing the low carbon steel sheet at a temperature of 500 to 800° C.;

cold-rolling the low carbon steel sheet at a reduction rate of not less than 60%; and annealing the low carbon steel sheet at a temperature of 400 to 500° C.

6. An aperture grille for use in a color picture tube, which is made of a low carbon steel sheet containing 9 to 30 wt % of Ni and 0.1 to 5 wt % of Co produced by the method according to claim 5.

* * * * *